US011112203B2

(12) United States Patent
Duncan et al.

(10) Patent No.: US 11,112,203 B2
(45) **Date of Patent: *Sep. 7, 2021**

(54) FORCE DAMPING SHOOTING REST SYSTEM AND METHOD

(71) Applicant: Guajilla Hunting Products, LLC, Liberty Hill, TX (US)

(72) Inventors: Marvin Badger Duncan, Liberty Hill, TX (US); Jeffrey Wade Steffen, New Braunfels, TX (US); Kevin Douglas Bowdy, Liberty Hill, TX (US); Stephen Clark Allison, Liberty Hill, TX (US)

(73) Assignee: GUAJILLA HUNTING PRODUCTS, LLC

( * ) Notice: Subject to any disclaimer, the term of this patent is extended or adjusted under 35 U.S.C. 154(b) by 0 days.

This patent is subject to a terminal disclaimer.

(21) Appl. No.: 16/197,554

(22) Filed: Nov. 21, 2018

(65) Prior Publication Data

US 2019/0093975 A1 Mar. 28, 2019

Related U.S. Application Data

(62) Division of application No. 15/092,753, filed on Apr. 7, 2016, now Pat. No. 10,139,182.

(60) Provisional application No. 62/144,444, filed on Apr. 8, 2015.

(51) Int. Cl.

| | |
|---|---|
| ***F41A 23/02*** | (2006.01) |
| ***F41A 23/56*** | (2006.01) |
| ***F41A 25/00*** | (2006.01) |
| ***F41A 25/10*** | (2006.01) |

(52) U.S. Cl.

CPC ..... *F41A 23/02* (2013.01); *F41A 23/56* (2013.01); *F41A 25/00* (2013.01); *F41A 25/10* (2013.01)

(58) Field of Classification Search

CPC ..... F41A 23/02; F41A 23/16; F41A 23/56
USPC ..... 42/94; 89/37.14, 37.04; 73/167
See application file for complete search history.

(56) References Cited

U.S. PATENT DOCUMENTS

| | | | | |
|---|---|---|---|---|
| 5,272,955 | A * | 12/1993 | Bond | F41A 23/58 89/37.04 |
| 10,139,182 | B2 * | 11/2018 | Duncan | F41A 23/02 |
| 2004/0134113 | A1 * | 7/2004 | Deros | F41A 23/02 42/94 |

* cited by examiner

*Primary Examiner* — Reginald S Tillman, Jr.
(74) *Attorney, Agent, or Firm* — The Law Firm of H. Dale Langley, Jr., PC

(57) ABSTRACT

A system for shooting an armament includes a connector configured to connect to a supporting structure, a side to side windage device connected to the connector, an up and down windage device connected to the connector, at least one guide rail connected to the up and down windage device, a carriage slidably connected to the at least one guide rail, and a gas spring connected to the carriage and the up and down windage device. The system rests a gun during shooting, assists steady aim, and limits any significant jarring and recoil impacting the gun, the system and any support, as well as virtually eliminates recoil force borne by the shooter.

12 Claims, 5 Drawing Sheets

FORCE DAMPING SHOOTING REST SYSTEM AND METHOD

CROSS-REFERENCE TO RELATED APPLICATIONS

The present application is a divisional of and has benefit of priority of U.S. patent application Ser. No. 15/092,753, titled "Force Damping Shooting Rest System and Method", filed on Apr. 7, 2016, which priority application which was a conversion of and has benefit of priority of U.S. Provisional Patent Application No. 62/144,444, titled "Motion Damping Gun Rest", filed Apr. 8, 2015. The priority application Ser. No. 15/092,753 has at least one same inventor of the present application and is herein incorporated by this reference.

TECHNICAL FIELD

The invention generally relates to gun rests, and more particularly relates to systems and methods for support, steadying aim, and damping recoil force of a firearm.

BACKGROUND

Conventional gun rests provide support for a firearm, such as a rifle or other gun. Although supportive of the firearm, those gun rests have typically been static supports in structure, with some designs including swivel or pivot allowing movement for aim side to side, up and/or down. These gun rests assist steady aim but do not provide any shock or recoil absorption.

Certain gun rests have attempted to provide shock or recoil absorption through compression padding, weights, mechanical coil springs and/or elastic fabrics. These conventional gun rests have typically been deficient. For example, the gun must be rigidly attached to the gun rest and may suffer scrape and structural damage from impact with the gun rest features. Further, the recoil absorption elements forcefully impact structures of the gun rest and any support structure on which the gun rest is attached, causing substantial jarring of the gun and distorting aim and also potential failure of the structural features of the gun rest and support structure.

It would, therefore, be a significant improvement in the art and technology to provide systems and methods for resting a gun during shooting, which assist steady aim and limit any significant jarring and recoil impacting the gun, gun rest and support structure, as well as virtually eliminating recoil force borne by the shooter.

SUMMARY

An embodiment of the invention is a system for shooting an armament in vicinity of a structure. The system includes a support component configured for attachment to the structure and a force resistive moveable component slidably engaged to the support component, the force resistive moveable component damps recoil force on shooting.

Another embodiment of the invention is a system for shooting an armament. The system includes a connector configured to connect to a supporting structure, a side to side windage device connected to the connector, an up and down windage device connected to the connector, a guide rail connected to the up and down windage device, a carriage slidably connected to the guide rail, and a gas spring connected to the carriage and the up and down windage device.

Yet another embodiment of the invention is a system for damping recoil of a gun when shooting. The system includes a carriage for retaining the gun, a gas spring connected to the carriage, and a support connected to the gas spring.

Another embodiment of the invention is a method of manufacture of a gun rest. The method of manufacture includes providing a carriage, providing a support, connecting the carriage to a guide rail connected to the support, and connecting a gas spring to the carriage and the support.

BRIEF DESCRIPTION OF THE DRAWINGS

The present invention is illustrated by way of example and not limitation in the accompanying figures, in which like references indicate similar elements, and in which.

DETAILED DESCRIPTION

The following description refers to certain specific embodiments; however, the specific embodiments are merely illustrative and variations and changes may be made in the embodiments without diverting from the broad scope encompassed by the disclosure.

Figure 1:
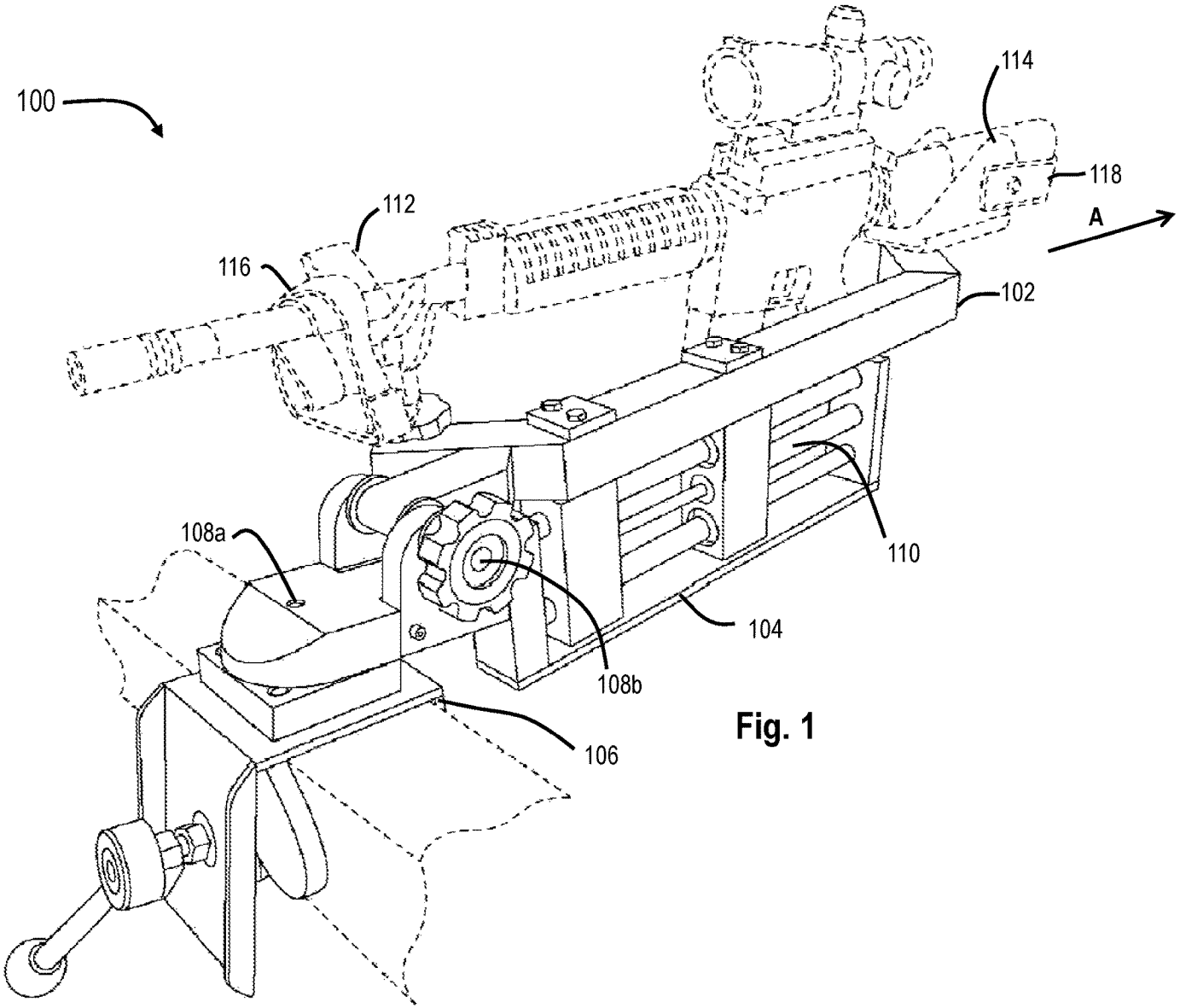
FIG. 1 illustrates a front and top perspective view of a system for resting a gun and damping recoil, according to certain embodiments.

Referring to FIG. 1, a system 100 includes a carriage 102 slidably connected to a support device 104. The support device 104 is connectable via a connector 106 of the support device 104, to a fixed or moving structure (shown in phantom). The carriage 102 is linearly slidable against resistance, directionally away from the connector 106 in the direction "A." The support device 104 may include one or more pivot pins 108*a, b*, such as for example, to allow the support device, together with the carriage 102, to pivot side to side (108*a*) and up and down (108*b*) (in the Figure) on the pivot pins 108.

A force resistive device 110 is connected to the carriage 102 and the support device 104. The force resistive device 110 resists sliding movement of the carriage 102 in relation to the support device 104 in the direction "A." The force resistive device 110 absorbs a recoil or other force directed on the carriage 106.

In operation, a rifle (shown in phantom) or other gun or armament is connected to the carriage 102, as non-exclusive example, via a Y fork device 112 for cradling an anterior portion of a gun (e.g., a rifle barrel or other) and a U-channel saddle device 114 for cradling a posterior portion of a gun (e.g., a rifle stock and end butt or other). The rifle or other gun may, but need not necessarily, be retained more securely to the carriage 102, such as for non-exclusive example, by a Velcro™ loop 116 and/or butt cuff 118. The rifle rests in connection to the carriage 102.

The rifle is selectively aimed by a shooter, by pivot on the pivot pin 108*a* in side to side movement and the pivot pin 108*b* in up and down movement, relative to the connector 106. Upon aim and firing, recoil and other movement of the rifle shifts the carriage 102 against the force resistive device 110 in relation to the support device 104. The force resistive device 110 absorbs the impact of recoil and other movement of the rifle. This can assist steady aim and limit any significant jarring and recoil impacting the rifle, support device 104, and connector 106, as well as virtually eliminating recoil force borne by the shooter.

Figure 2:
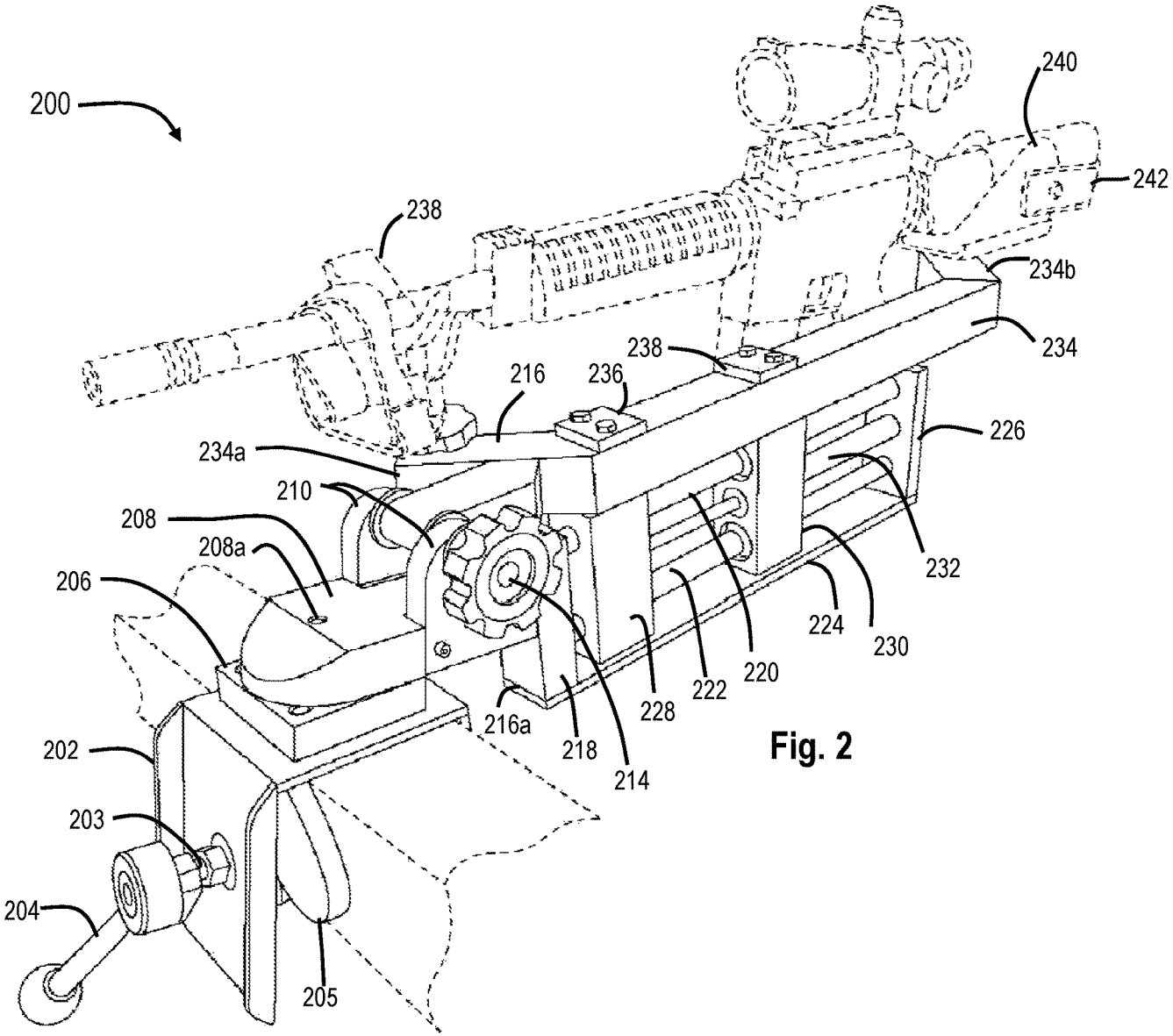
FIG. 2 illustrates a front and top perspective view of a system for resting a gun for steady aim and damping recoil of shooting, according to certain embodiments.

Referring to FIG. 2, in conjunction with FIG. 1, a system 200, such as for non-exclusive example, the system 100 of FIG. 1, includes a support attachment 202. The support attachment 202 is removably connectable to a hunting blind, bench, car or Humvee door, or other fixed or moveable generally horizontally (or otherwise) disposed structure. The support attachment 202 may, as non-exclusive example, form a generally inverted "U" shape with somewhat squared corners, such as can fit along an edge or jamb of a wall, window sill, hunting blind, bench, vehicle door or sill, or other structure. The support attachment 202 may include an attachment device, for non-exclusive example, such as a screw 203 extending through a threaded hole of a side of the support attachment 202. A handle 204 or other grip may be connected to the screw 203 to assist manual turn, to secure the screw 203, for non-exclusive example, via a connected pad 205 or otherwise, against the edge or jamb.

A mount plate 206 connects to the support attachment 202. The mount plate 206 is, as non-exclusive example, a generally rectangular plate. The generally rectangular plate in the example connects to the connector 202, as non-exclusive example, at a flat base or other portion of the inverted U of the connector 202. The mount plate 206 may, for example, be connected fixedly, or removably by four or other number of screws or otherwise, to the connector 202 in certain embodiments. In use, the mount plate 206 is substantially stationary in relation to the support attachment 202.

A side to side windage assembly 208 is pivotally connected to the mount plate 206 by a pivot pin 208*a*. The side to side windage assembly 208 allows side to side (in the Figure) adjustment of aim of a rifle or other gun (shown in phantom) in relation to the connector 202. The side to side windage assembly 208 includes or is connected to an up and down windage assembly 210.

The up and down windage assembly 210 pivotally connects a support structure 216 to the side to side windage assembly 208. The up and down windage assembly 210, for non-exclusive example, forms parallel shoulders configured with a pivot fulcrum. The pivot fulcrum is fitted with a pivot pin 214, such as, for non-exclusive example, a screwable positioning assembly having a manually securable knob 212. The up and down windage assembly 210 allows up and down (in the Figure) adjustment of aim of a rifle or other gun (shown in phantom) in relation to the side to side windage assembly 208.

An elbow support device 216 is pivotally connected to the pivot pin 214. The elbow support device 216 is, as non-exclusive example, an inverted L shape that is pivotally retained by the pivot pin 214. The elbow support device 216 extends from the pivot pin 214 to form or connect to a bottom leg support device 218. The bottom leg support device 218 in certain embodiments includes two retainers, which provide support for upper and lower guide rails 220, 222, respectively.

An extended end 216*a* of the elbow support device 216 is connected to a bottom support device 224. The bottom support device 224 extends at least sufficient to accommodate the lengths of the upper and lower guide rails 220, 222 between the elbow support device 216 and an end support 226. The end support 226 is connected to bottom support device 224, for non-exclusive example, the end support 226 extends substantially parallel to the bottom leg of the inverted L shape of the elbow support device.

The upper and lower guide rails 220, 222 support a front block 228 and a back block 230 in slidable engagement along the guide rails 220, 222. The front block 228 is connected to a force resistive member 232. The back block 230 slidably engages with respect to the force resistive member 232. Each of the front block 228 and back block 230 may include bushings to aid the slidable engagement of the front block 228 with the guide rails 220, 222 and the back block 230 with the guide rails 220, 222 and the force resistive member 232.

The force resistive member 232 is, as non-exclusive example, a gas spring device or another compression force resistive device. The force resistive member 232 biases the front block 228 in a position towards the bottom leg support device 218 along the guide rails 220, 222. The force resistive member 232 resists movement of the front block 228 along the guide rails 220, 222 away from the bottom leg support device 218 as the front block is forced, such as by recoil of a gun or rifle, along the guide rails towards the end support 226.

The front block 228 and the back block 230 each is connected to a carriage rail 234. As non-exclusive example, the front block 228 is connected to the carriage rail 234 by a front pad 236 that is screwed or otherwise fixedly or removably attached to the carriage rail 234 and the front block 228. Also as non-exclusive example, the back block 230 is connected to the carriage rail 234 by a back pad 238 that is screwed or otherwise fixedly or removably attached to the carriage rail 234 and the back block 230.

The carriage rail 234 may, but need not necessarily, form a length with fore and aft wings 234*a*, 234*b*. The fore and aft wings 234*a*, 234*b*, respectively, or otherwise as to the carriage rail 234, may be fitted with support structures for retaining a rifle, gun or other firearm or armament. For non-exclusive example, each wing 234*a*, 234*b* may include a hole for attachment of support structure(s). The support structures may be fixedly or removably connected to the carriage rail 234, as non-exclusive example, the support structures may include a front Y support 238 and a back saddle support 240, as well as other elements, such as for example, a Velcro™ tie, a butt cuff 242, and/or other device or devices.

In operation, the system 200 is secured to a fixed or movable (e.g., a truck window sill) structure via the support attachment 202. The support attachment 202 is, as non-exclusive example, secured by manually gripping the handle 204 and tightening the screw 203 so that the pad 205, together with the support attachment 202, grips the applicable structure. Once secured, a rifle, gun or other firearm or armament is placed resting on the carriage rail 234 of the system 200, for example, in support structures (e.g., a front Y support 238 and a back saddle support 240) connected to respective wings 234*a*, 234*b* of the carriage rail 234.

The rifle or other firearm or armament is movably aimed by the shooter, for lateral (e.g., side to side) positioning in the Figure, via pivoting of the pivot pin 208*a* connecting the side to side windage assembly 208 to the mount plate 206. The rifle or other firearm or armament is movably aimed by the shooter, for vertical (e.g., up and down) positioning in the Figure, via pivoting of the pivot pin 214 connecting the up and down windage assembly 210 to the side to side windage assembly 208. The vertical aim positioning may be substantially secured in fixed relation by tightening (or loosening, as desired and applicable) the manually securable knob 212.

Once desired aim is obtained, the shooter can squeeze a trigger and shoot the rifle or other firearm or armament. Recoil and other impact of the shot is damped by the gas spring or other force resistive member 232. The recoil or other impact is to the assembly of the carriage rail 234, the front block 228 and the back block 230. The front block 228, coupled to the force resistive member 232, resists extensive slide of the front block 228, the back block 230 and the carriage rail 234, as assembled, along the guide rails 220, 222. The system 200 effectively assists and limits disruption of aim, and also absorbs recoil to limit impact to the shooter and the support attachment 202, the side to side windage assembly 208, the up and down windage assembly 210 and other portions of the system 200 and the structure to which attached.

Any materials, suitable for intended purposes in the embodiments, may form the systems 100 and 200. In certain non-exclusive examples, aluminum, other metal, composite, or other materials form the carriage and support structures of the systems 100 and 200. Those materials may be machined, molded or otherwise shaped or formed to perform the applicable operations and processes. In certain non-exclusive embodiments, a gas spring, spring, piston, compression rubber, and/or other force resistive member, or combinations, couples to the carriage (such as via a front block) and the carriage is guided on rails or other guide for movement in damping recoil. Bushings, such as bearings, linings and/or other, of metal, plastic, or otherwise, may provide smooth glide of the carriage with respect to the support structures.

Figure 3:
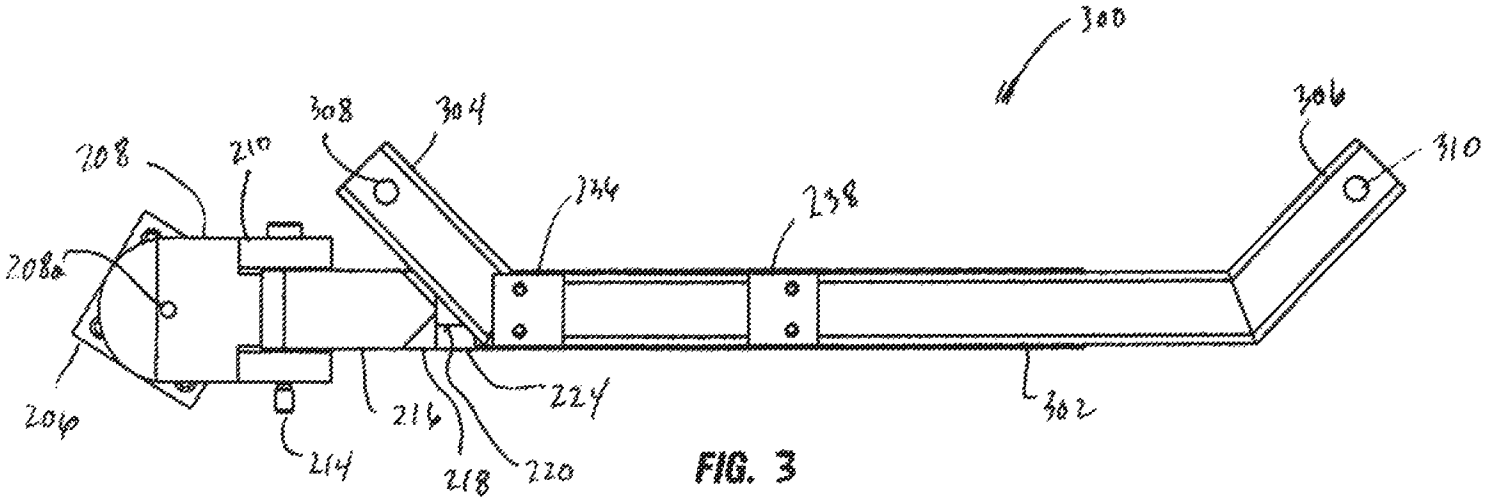
FIG. 3 illustrates a top view of a system for resting a gun for steady aim and damping recoil of shooting, including support components and moveable carriage, according to certain embodiments.

Referring to FIG. 3, in conjunction with FIGS. 1 and 2, a system 300, such as portions of the systems 100 and 200, includes a carriage 302 formed of a square in cross-section tube or other length of structure. The carriage 302 includes or is connected to wings 304, 306, respectively, at the aft end and the posterior end. Respective holes 308, 310 formed of the aft end and the posterior end, respectively, may be offset substantially equidistant from the main length of the carriage 302, to serve to receive support structures for a rifle, gun, or other firearm or armament, such as a Y fork device, a saddle device or otherwise for holding the firearm or armament.

Respective fore and aft pads 236, 238 connect to the carriage 302 and to fore and aft blocks (shown in FIGS. 1 and 2), as previously described. The carriage 302 in the arrangement of FIG. 3 may be desired by right shooters, because the firearm or armament will be held on the right side of the system 300 in use. Alternatively, the carriage 302 can be arranged with wings 304, 306 to the other side of the system 300, for non-exclusive example, by disconnecting the pads 236, 238 from the carriage 302 and fore and aft blocks, respectively, such as by unscrewing the pads 236, 238 or as otherwise may be provided.

The carriage 302 slidably connects to the upper rail 220 and bottom rail 222 (not shown in FIG. 3). The carriage 302 connects to the force resistive member 232 (not shown in FIG. 3), for non-exclusive example, via the fore block 228 (not shown in FIG. 3). The guide rails 220, 222 connect to support devices, for non-exclusive example, the elbow support device 216, the bottom support device 224, and the end support 226 (not shown in FIG. 3), and the elbow support device 216 is pivotally connected to the side to side windage assembly 208, which is pivotally connected to the mount plate 206.

Figure 4:
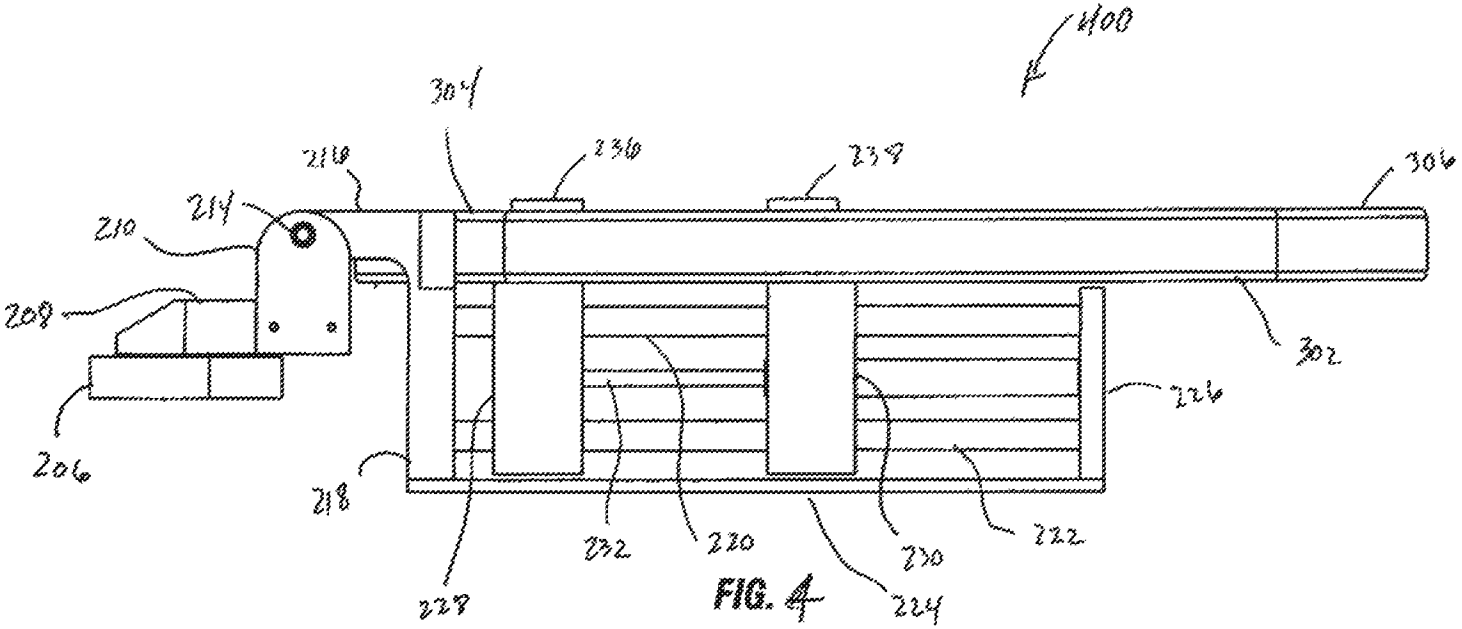
FIG. 4 illustrates a left side view of a system for resting a gun for steady aim and damping recoil of shooting, including support components and impact resistive moveable components fixed with a carriage, according to certain embodiments.

Referring to FIG. 4, in conjunction with FIG. 3, a system 400 includes the carriage 302 slidably connected to the upper and lower guide rails 220, 222, by the front block 228 and the back block 230 secured by the pads 236, 238, respectively. The front block 228 is connected to an end of the force resistive member 232. The force resistive member 232 passes through the back block 230, for example, via a bushing or otherwise, and is connected at another end to the end support 226. The carriage 302 is slidable against the force resistive member 232 along the guide rails 220, 222, to absorb recoil and other forced movement of the carriage 302 with respect to the rest of the system 400.

Figure 5:
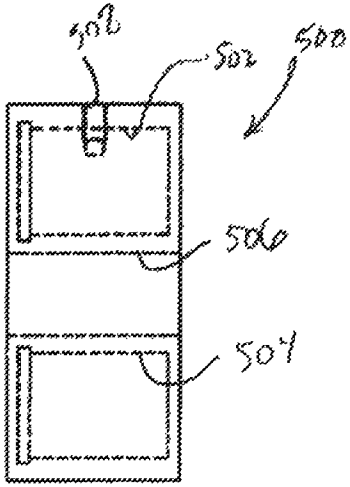
FIG. 5 illustrates a left side view of a system for guiding a carriage along support components of guide rails for resting a gun for steady aim and damping recoil of shooting, according to certain embodiments.

Referring to FIG. 5, in conjunction with FIGS. 3 and 4, a system 500, in accordance with the back block 230, includes a top throughway 502 and a bottom throughway 504, as well as an intermediate throughway 506. The top throughway 502 is sized to accommodate any bushing (not shown) as well as the upper guide rail 220 for slidable engagement. The bottom throughway 504 is sized to accommodate any bushing (not shown) as well as the lower guide rail 222 for slidable engagement. The intermediate throughway 506 is sized to accommodate the force resistive member 232 without engagement of the force resistive member 232. The force resistive member 232, if a gas spring or similar extending length configured for recoil force damping, freely operates passing through the system 500 without interference of the system 500. The system 500 may include a connector 508, for non-exclusive example, a screw hole or other device, for connection to the carriage 302 and the back pad 238.

Figure 6:
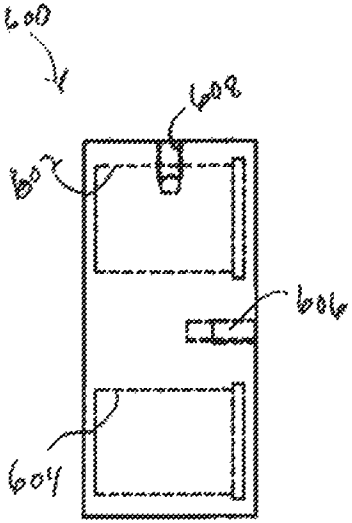
FIG. 6 illustrates a left side view of a system for connecting to a force resistive member and guiding a carriage along support components of guide rails for resting a gun for steady aim and damping recoil of shooting, according to certain embodiments.

Referring to FIG. 6, in conjunction with FIGS. 3-5, a system 600, in accordance with the front block 228, includes a top throughway 602 and a bottom throughway 604, as well as an intermediate connector 606. The top throughway 602 is sized to accommodate any bushing (not shown) as well as the upper guide rail 220 for slidable engagement. The bottom throughway 604 is sized to accommodate any bushing (not shown) as well as the lower guide rail 222 for slidable engagement. The intermediate connector 606 is configured to mate with an end of the force resistive member 232, such that the force resistive member 232 resists movement of the system 600 along the upper and lower guide rails 22, 222, for non-exclusive example, to damp recoil force. The system 600 may include a connector 608, for non-exclusive example, a screw hole or other device, for connection to the carriage 302 and the front pad 236.

Figure 7:
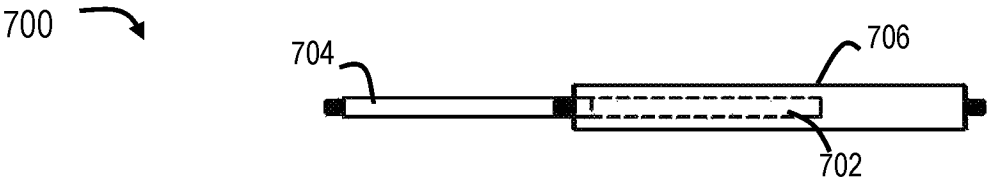
FIG. 7 illustrates a side view of a system for resisting an impact, such as a recoil from a gun or other armament, according to certain embodiments.

Referring to FIG. 7, a system 700 is a non-exclusive example of a device for damping recoil and other force, such as, for example, the force resistive member 232. The system 700 includes a gas spring 702. The gas spring 702 extends to a fore end 704 and an aft end 706. The fore end 704 may, for non-exclusive example, include a solid rod for connection to the front block 228 or otherwise with elements fixed in relation to the carriage 232. The aft end 706 may, for non-exclusive example, include a cylinder into which the fore end 704 may pass and which mates with the end support 226 or otherwise with elements fixed in relation to the supports of the system 100, 200, 300, and/or 400. The gas spring 702 connects the fore end 704 and the aft end 706. In operation, the fore end 704 slides into the aft end 706 against resistance of the gas spring 702.

Figure 8:
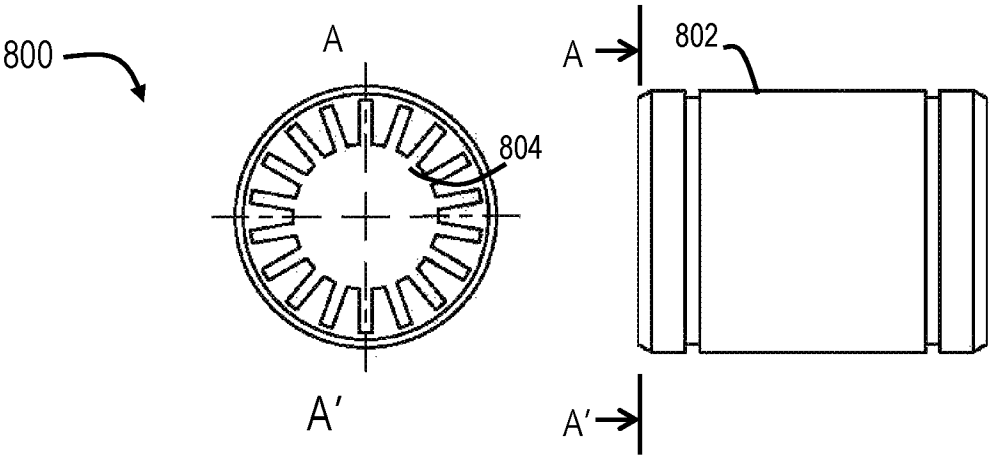
FIG. 8 illustrates a side and cross-section view of a bushing for connection to impact moveable components fixed with a carriage and support components of guide rails, according to certain embodiments.

Referring to FIG. 8, a system 800 is a non-exclusive example of a bushing 802, such as may connect to the top throughways 502, 602, respectively, and bottom throughways 504, 604, respectively, for slidable engagement of the systems 500, 600 with the upper and lower guide rails 220, 222, respectively. The bushing 802, in non-exclusive example, may include a bearing (not shown) and/or other device(s), as well as guide elements 804.

Wide variations and alternatives are possible in the embodiments. Generally, in certain non-exclusive alternatives, the supports of the gun rest allow pivoting side to side and up and down aim movement, but remain fixed/still when shooting in relation to any support structure to which attached. The supports of the gun rest remain substantially fixed/still in relation to the support structure to which attached. The carriage and force resistive elements of the gun rest resist impact through slidable engagement with the supports of the gun rest, and after shooting promptly return to substantially same position as just prior to shooting.

In other certain non-exclusive alternatives, materials and configurations of components may be widely varied. For non-exclusive example, materials may include aluminum, metal, plastic, composite or other, and various components may be of same or different materials as desired for the embodiment. In other non-exclusive example, particular form or configuration of elements or components may be varied to achieve same or similar operations. The support components of the gun rest can include any of various attachments or connectors, for non-exclusive example, screw, pad, gripper, spring, or others, for retaining the support components to a fixed or moveable support structure, such as a hunting blind, window sill, car or Humvee door or window sill, or otherwise.

Further in other certain non-exclusive examples, the moveable components of the carriage may be formed of any number of elements, including unitarily formed or formed of separate or segregated components. For non-exclusive example, the front and/or back blocks may be unitary with the carriage, or else may be separate parts connectable by screws, pads and otherwise. If the front and/or back blocks are separate parts, the carriage may be varied from one side or the other of the support components, such as to provide for right or left shooting. Similarly, the support components of the connector, the mount plate, and pivoting elements may be formed of any number of parts, including unitarily formed or formed of separate or segregated components, such as the side to side windage assembly and/or the up and down windage assembly.

In even more certain non-exclusive embodiments, the gun rest may include, incorporate or attach to other and different rifles, firearms, and other armaments. The Y fork device and the saddle device may be any suitable devices or features connected to the carriage and sufficient for holding the gun, rifle, firearm or other armament. Additional features, such as loops, cuffs, and others are includable, incorporatable, or attachable. In certain non-exclusive examples, a camera, spotter scope, laser light, or other device is attachable or included in the gun rest, for example, attached to the support components or the moveable carriage components, as desired.

In certain non-exclusive alternatives, the systems and methods are incorporated, in whole or part, as a service or product. In other non-exclusive alternatives, the systems and methods are incorporated, in whole or part, in or with a turn-key product or service, or a sale, rental, or other application or scheme. Although particular components, parts, units, modules, or other elements are illustrated as unitary (or not) in the embodiments, it is contemplated that certain of those components, parts, units, modules or other elements may be included in whole or part as features that interact with or incorporate other components, parts, units, modules or elements (including, for example, third party parts or elements) or that are combined in whole or part with other components, parts, units, modules or elements.

In the foregoing, the invention has been described with reference to specific embodiments. One of ordinary skill in the art will appreciate, however, that various modifications, substitutions, deletions, and additions can be made without departing from the scope of the invention. Accordingly, the specification and figures are to be regarded in an illustrative rather than a restrictive sense, and all such modifications substitutions, deletions, and additions are intended to be included within the scope of the invention. Any benefits, advantages, or solutions to problems that may have been described above with regard to specific embodiments, as well as device(s), connection(s), step(s) and element(s) that may cause any benefit, advantage, or solution to occur or become more pronounced, are not to be construed as a critical, required, or essential feature or element.

What is claimed is:

1. A system for shooting an armament, a structure is in vicinity of the armament, comprising:

a support device configured for attachment to the structure;

a pivot device connected to the support device, providing up and down and side to side movement with respect to the support device;

a guide rail connected to the pivot device, the guide rail extending longitudinally from the pivot device and moveable swinging up and down and side to side;

a fork device connected to the guide rail for cradling the armament; and a force resistive moveable component extending longitudinally in parallel with the guide rail, the force resistive moveable component damps recoil force of the fork device on shooting.

2. The system of claim 1, wherein the support device includes a first pivot point and a second pivot point, the first pivot point and the second pivot point are in perpendicular relation.

3. The system of claim 2, wherein the force resistive moveable component includes:

a gas spring, the gas spring damps recoil effect with respect to the support device.

4. A system for damping recoil of a gun when shooting, comprising:

a carriage for retaining the gun;

a windage device connected to the carriage, providing up and down and side to side movement of the carriage with respect to the windage device;

a guide rail connected to the carriage, the guide rail extending longitudinally along the carriage; and a guide block slidably connected to the guide rail; and a gas spring connected to the guide block and the carriage.

5. The system of claim 4, wherein the windage device includes:

a first pivot point connected to the carriage; and a second pivot point connected to the first pivot point.

6. The system of claim 4, further comprising:

a connector connected to the windage device, configured to be attachable to a structure.

7. The system of claim 6, wherein the structure is selected from the group consisting of: hunting blind, window sill, vehicle door, vehicle window, and other structure.

8. A method of manufacture of a gun rest for a gun, comprising:

providing a carriage for the gun;

providing a windage device;

connecting the windage device to the carriage for up and down and side to side movement of the carriage with respect to the windage device;

connecting the carriage to a guide block;

connecting a guide rail to the carriage extending longitudinally with the carriage from the windage device;

slidingly connecting the guide block to the guide rail; and connecting a gas spring to the guide block and the carriage, the gas spring damps movement of the carriage with respect to the windage device.

9. The method of manufacture of claim 8, further comprising:

forming the windage device with a first pivot; and connecting the first pivot to the carriage.

10. The method of manufacture of claim 9, further comprising:

providing the windage device with a second pivot;

connecting the second pivot to the first pivot and to the carriage;

wherein the windage device provides multidimensional range of movement of the carriage with respect to the windage device.

11. The method of manufacture of claim 8, wherein the step of providing the windage device includes machining.

12. The method of manufacture of claim 8, wherein the providing the carriage includes forming wings for retention of the gun.

* * * * *